US008275297B2

(12) United States Patent
Izawa et al.

(10) Patent No.: US 8,275,297 B2
(45) Date of Patent: Sep. 25, 2012

(54) ELECTRONIC PHOTOGRAPH PRINTER

(75) Inventors: Hideo Izawa, Sakura (JP); Junichi Setoyama, Yachimata (JP); Kouichi Ooyama, Daisen (JP)

(73) Assignee: Miyakoshi Printing Machinery Co., Ltd. (JP)

( * ) Notice: Subject to any disclaimer, the term of this patent is extended or adjusted under 35 U.S.C. 154(b) by 537 days.

(21) Appl. No.: 12/343,849

(22) Filed: Dec. 24, 2008

(65) Prior Publication Data

US 2009/0169271 A1 Jul. 2, 2009

(30) Foreign Application Priority Data

Dec. 28, 2007 (JP) ..... 2007-338885

(51) Int. Cl.
*G03G 15/08* (2006.01)

(52) U.S. Cl. ..... 399/279

(58) Field of Classification Search ..... 399/264, 399/279, 313
See application file for complete search history.

(56) References Cited

U.S. PATENT DOCUMENTS

| | | | | |
|---|---|---|---|---|
| 5,182,601 | A * | 1/1993 | Hodoshima et al. | 399/258 |
| 5,442,426 | A | 8/1995 | Yamamura et al. | |
| 6,259,873 | B1 | 7/2001 | Shifley et al. | |
| 6,427,059 | B1 | 7/2002 | Buch et al. | |
| 2002/0197083 | A1 | 12/2002 | Yoshino et al. | |
| 2004/0096240 | A1* | 5/2004 | Kim | 399/222 |
| 2006/0013612 | A1* | 1/2006 | Shoji | 399/111 |

FOREIGN PATENT DOCUMENTS

| | | | |
|---|---|---|---|
| EP | 1801662 | A1 | 6/2007 |
| JP | 8-30100 | | 2/1996 |
| JP | 8-190288 | A | 7/1996 |
| JP | 11-327297 | A | 11/1999 |
| JP | 2001-13851 | A | 1/2001 |
| JP | 2004-29822 | A | 1/2004 |
| JP | 2004-109340 | A | 4/2004 |

OTHER PUBLICATIONS

Machine translation of JP 2004-109340 A.*

European Search Report for Application No./Patent No. 08172763.8-1240 / 2075640 dated Jan. 13, 2010.

Japanese Office Action for Japanese Patent Application No. 2007-338885 mailed Dec. 18, 2009 with English translation.

Extended European Search Report for European Application No. 08172763.8-1240 dated Mar. 8, 2011.

Japanese Office Action for Application No. 2007-338885 mailed Mar. 16, 2010 with English translation.

* cited by examiner

*Primary Examiner* — Walter Lindsay, Jr.
*Assistant Examiner* — Ruth Labombard
(74) *Attorney, Agent, or Firm* — Cantor Colburn LLP

(57) ABSTRACT

An electronic photograph printer is provided for elastically biasing the developer apparatus having the photosensitive drum by the pressing mechanism and for pressing the developer roll onto the photosensitive drum. In this configuration, quality in the developed image can be ensured by the trackable movement of the developer roll relative to the photosensitive drum in the electronic photograph printer. In addition, adjustable range for positioning the developer roll and operability and maintainability within the developer apparatus can be achieved.

8 Claims, 9 Drawing Sheets

ELECTRONIC PHOTOGRAPH PRINTER

The present application is based on patent application No. 2007-338885 filed in Japan on Dec. 28, 2007, the content of which is incorporated herein by reference.

BACKGROUND OF THE INVENTION

1. Field of the Invention

The present invention relates to an electronic photograph printer, and in particular, relates to an electronic photograph printer provided with a photosensitive drum and a developer apparatus which supplies toner to the surface of a photosensitive drum by using a rotative developer roll making contact with the photosensitive drum, and forms a toner image, which is obtained by visualizing a static latent image formed on the surface of the photosensitive drum, on the surface of the photosensitive drum.

2. Description of the Related Art

A conventional electronic photograph printer of this kind is disclosed in Patent Document 1.

An electronic photograph printer (electronic photograph apparatus) disclosed in the Patent Document 1 is provided with: a photosensitive drum rotative relative to a recording paper; an static-charging unit for statically charging the surface of the photosensitive drum; an exposure unit for forming a static latent image on the surface of the photosensitive drum statically charged by the static-charging unit; and a developer roll using toner for visualizing the static latent image formed on the photosensitive drum by rotating reversely relative to the photosensitive drum while making contact with the photosensitive drum and rotating. In this configuration, the developer roll is supported so that it is separable or accessible relative to the photosensitive drum, and the developer roll is pressurized onto the photosensitive drum by a pressing mechanism.

See Patent document 1: Japanese Unexamined Patent Application, First Publication No. H8-30100

In addition to the developer roll, however, the developer apparatus of the electronic photograph printer has a cleaner roll, a toner supplier roll, and the like. In this configuration, adjustment of the position of the developer roll relative to the cleaner roll or the toner supplier roll may be inconvenient if the developer roll is capable of making trackable movement with the photosensitive drum.

In addition, the configuration allowing the developer roll to make trackable movement with the photosensitive drum may be disadvantageous because the adjustability for adjusting the contact pressure or the like between the developer roll and another non-developer roll in the developer apparatus will be limited in a narrow range; therefore, such adjustment for an ordinary skilled person in the art will need extra skill that requires time and effort to obtain. Such configuration has been unprofitable because of its poor operability and maintenance capability.

SUMMARY OF THE INVENTION

In view of the aforementioned problems, an object of the present invention is to provide an electronic photograph printer that is capable of ensuring developed image quality by means of the movement of the developer roll that is trackable with the movement of the photosensitive drum and is capable of improving operability and maintainability within the developer apparatus based on a significant positioning adjustability for the developer roll.

In an attempt to solve the aforementioned problems, the present invention provides the following configuration.

A first aspect of the present invention provides an electronic photograph printer which includes: a photosensitive drum that is rotative relative to a recording paper; a static-charging apparatus for statically charging a surface of the photosensitive drum uniformly; an exposure apparatus for forming a static latent image on the surface of the photosensitive drum statically charged by the static-charging apparatus; a rotative developer roll making contact with the photosensitive drum; a developer apparatus for supplying a toner from the developer roll to the photosensitive drum and forming a toner image by visualizing the static latent image onto the surface of the photosensitive drum; at least a guide rail capable of guiding linear motion of the freely advancing or retracting developer apparatus thereon relative to the photosensitive drum; and at least a pressing mechanism for discharging an elastically biasing force to the developer apparatus and pressing the developer roll of the developer apparatus onto the photosensitive drum.

A second aspect of the present invention provides the electronic photograph according to the first aspect of the present invention in which the developer apparatus includes: the developer roll; and a pair of developer apparatus frames each having bearings for receiving a roll shaft of the developer roll and supporting two ends of the roll shaft, and each developer apparatus frame has the guide rail and the pressing mechanism.

A third aspect of the present invention provides the electronic photograph printer according to one of the first and second present invention in which the pressing mechanism has a press-switching unit for switching the biasing force applied to the developer apparatus between continued state and suspended state, and the developer roll of the developer apparatus freely advances or retracts relative to the photosensitive drum by moving the developer apparatus along the guide rail while the elastic biasing force applied by the pressing mechanism to the developer apparatus is suspended.

A fourth aspect of the present invention provides the electronic photograph printer according to the second aspect of the present invention in which the developer apparatus further includes a toner supplier roll and a cleaner roll; the toner supplier roll supplies the toner onto a surface of the developer roll; the cleaner roll for removing the toner from the surface of the developer roll is disposed downstream in a rotating direction of the developer roll relative to a position where the developer roll makes contact with the photosensitive drum and is disposed upstream in the rotating direction of the developer roll relative to the toner supplier roll; and the toner supplier roll and the cleaner roll are rotatably supported by the developer apparatus frames.

A fifth aspect of the present invention provides the electronic photograph printer according to the first aspect of the present invention which further includes: a rotative transfer roll making contact with the photosensitive drum for transferring the toner image formed on the surface of the photosensitive drum onto the recording paper from the photosensitive drum; a pair of transfer-roll-support members each having a bearing for supporting each one of two ends of the roll shaft of the transfer roll while the pair of transfer-roll-support members is movable relative to a main frame of the electronic photograph printer; and a transfer-roll-pressing mechanism for elastically biasing each transfer-roll-support member and pressing the transfer roll onto the photosensitive drum while the transfer-roll-pressing mechanism is provided to each transfer-roll-support member.

A sixth aspect of the present invention provides the electronic photograph printer according to the fifth aspect of the present invention in which the transfer-roll-pressing mechanism includes a transfer-roll-press-switching unit for switching the elastic biasing force applied to the transfer-roll-support member between continued state and suspended state, so that the transfer roll is capable of freely separating from the photosensitive drum while the elastic biasing force applied by the transfer-roll-pressing mechanism to the transfer-roll-support member is suspended.

EFFECTS OF THE INVENTION

The developer roll of the electronic photograph printer according to the present invention achieves capability of trackability with the movement of the photosensitive drum by means of the elastic biasing force applied by the pressing mechanism to the developer apparatus. The pressing mechanism elastically biases the developer apparatus while the position of the developer roll therein is fixed. Accordingly, adjustment in the developer apparatus can by simplified, and the developer apparatus can maintain the post-adjustment state reliably, because the trackable movement of the developer roll in accordance with the movement of the photosensitive drum does not affect the adjustment work conducted within the developer apparatus. This results in improving the operability and maintainability within the developer apparatus. In addition, the trackable movement of the developer roll in accordance with the movement of the photosensitive drum ensures satisfactory developed image quality.

DETAILED DESCRIPTION OF THE INVENTION

An example of electronic photograph printer as an implementation of the present embodiment will be explained as follows with reference to drawings.

Figure 1:
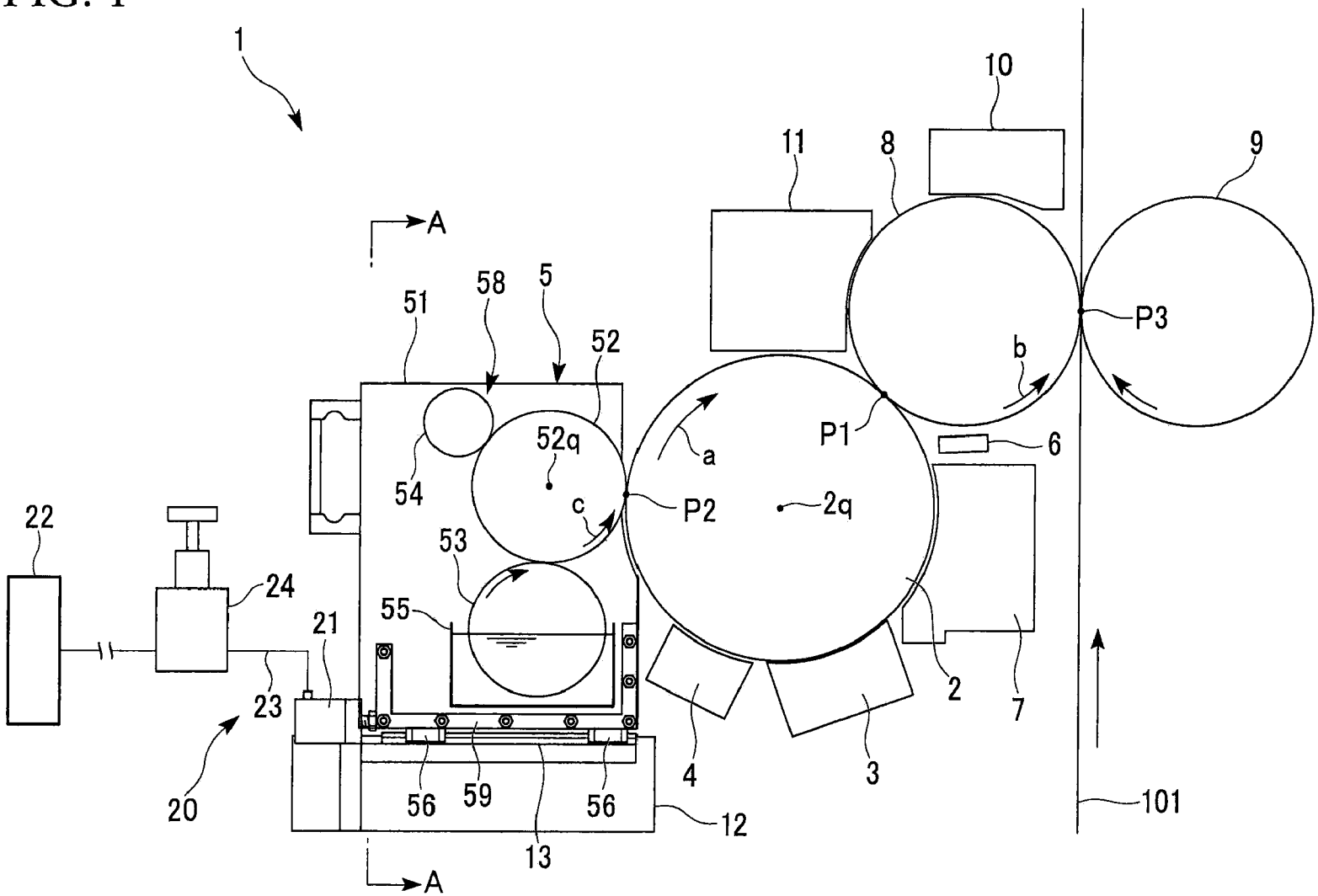
FIG. 1 is a front elevation showing an embodiment of an electronic photograph printer according to the present invention.
Figure 2:
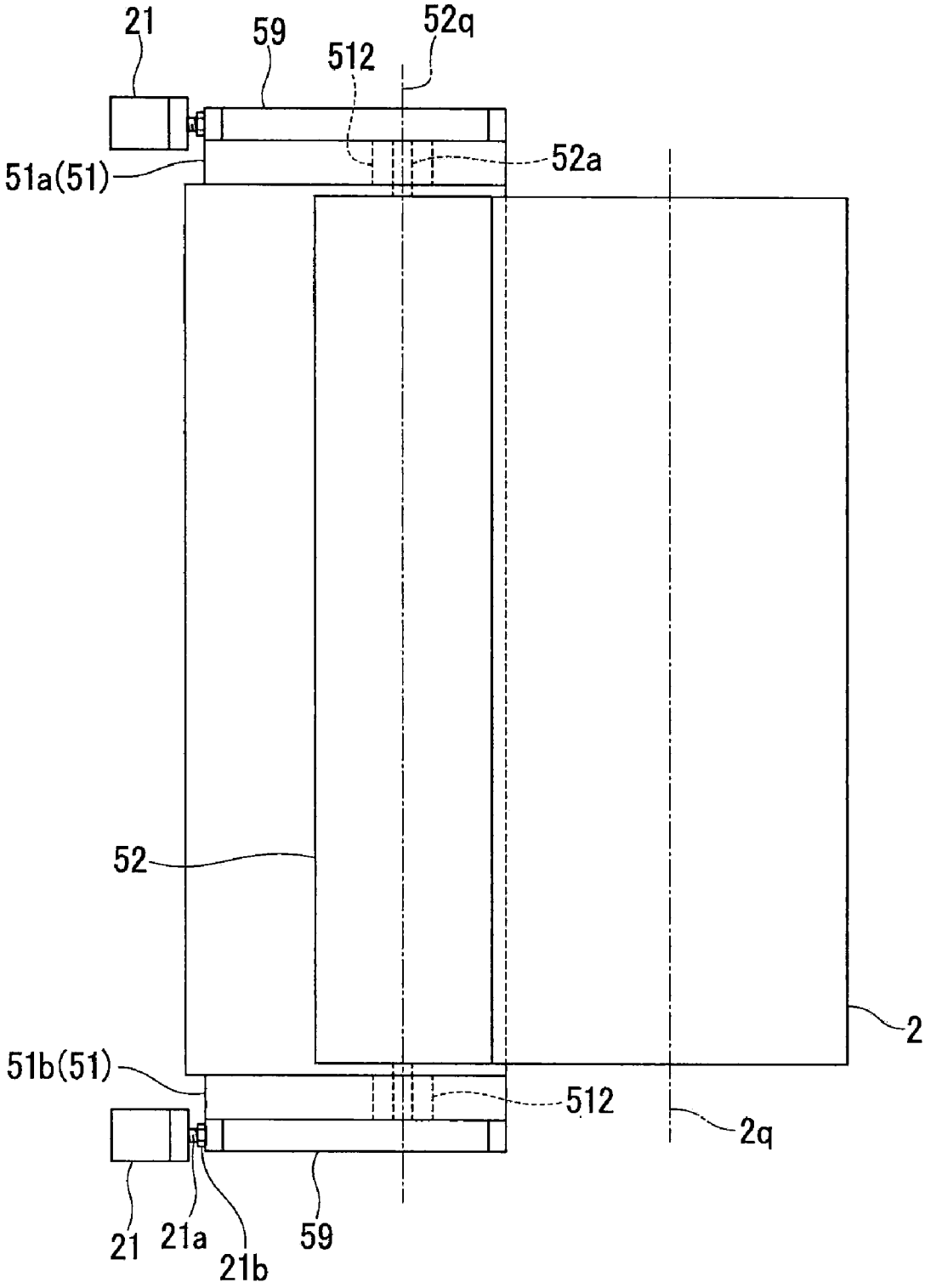
FIG. 2 is a plan view showing correlation among the photosensitive drum of the electronic photograph printer, a developer apparatus, and an air cylinder apparatus of a pressing mechanism shown in FIG. 1.
Figure 3:
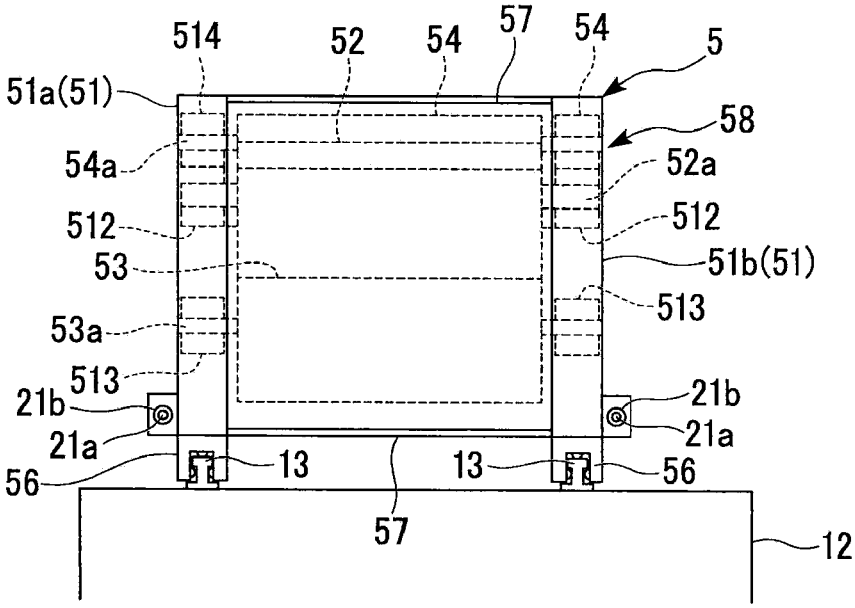
FIG. 3 shows correlation between a pair of developer apparatus frames and guide rails of the developer apparatus taken along the line A-A of FIG. 1.
Figure 4:
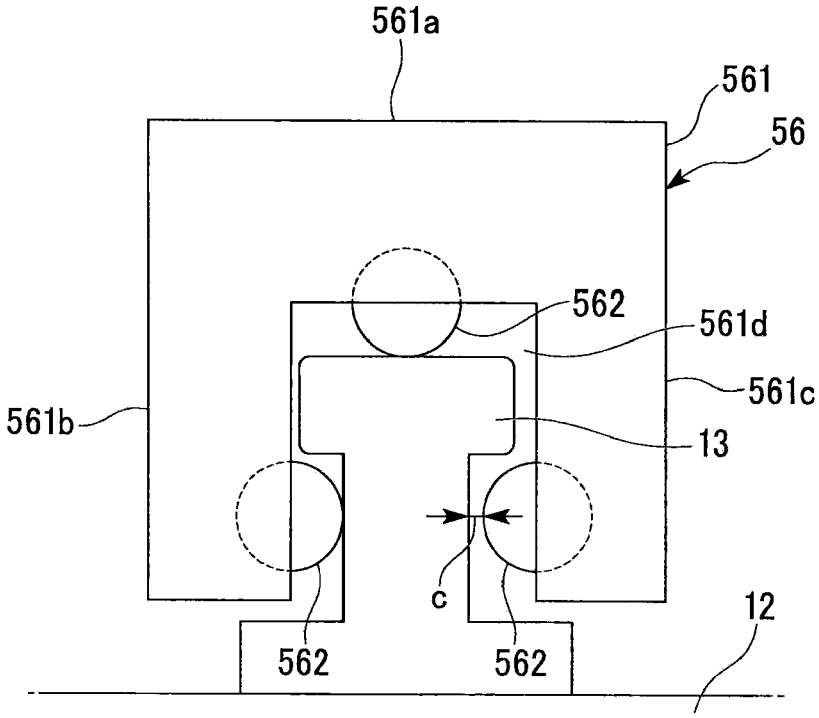
FIG. 4 shows clearance obtained between rolling balls 562 of the movers provided in the developer apparatus frame, and the guide rails.
Figure 5:
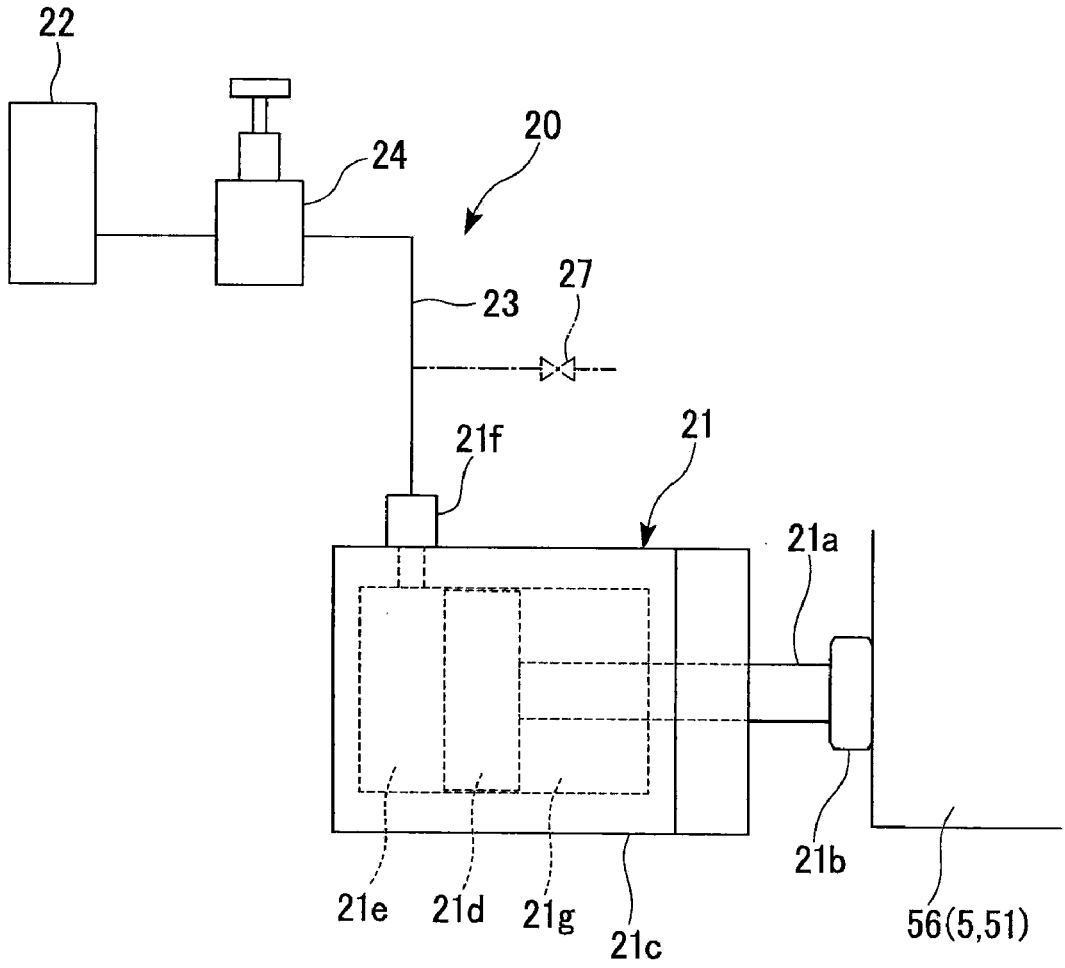
FIG. 5 shows an example of pressing mechanism adopted in the electronic photograph printer according to the present invention.
Figure 6:
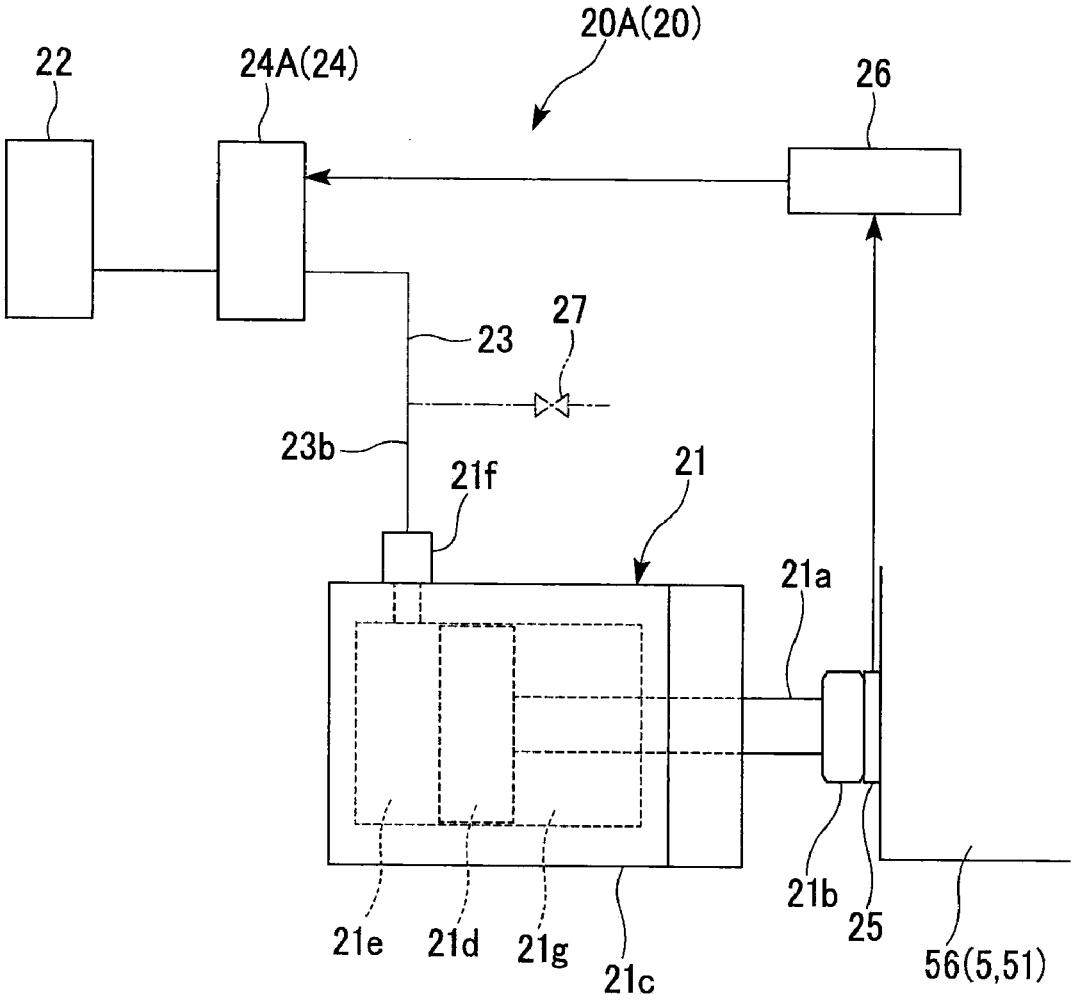
FIG. 6 shows another aspect of the pressing mechanism adopting an electro-pneumatic transducer.
Figure 7A:
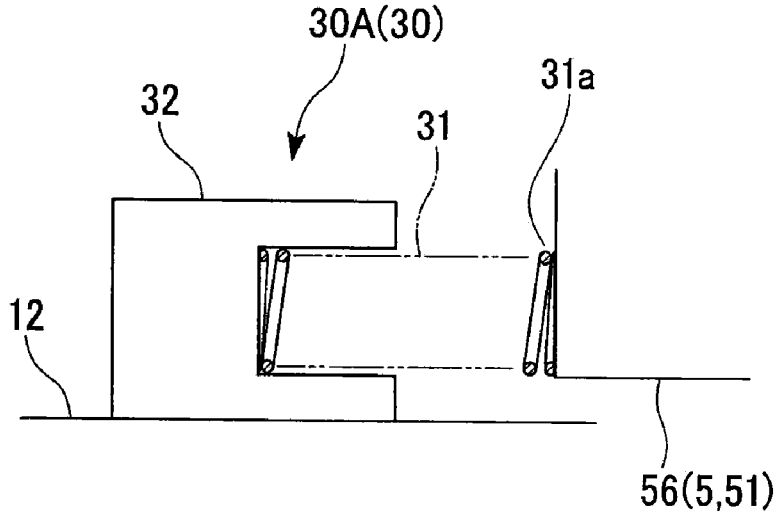
FIGS. 7A and 7B show an example of pressing mechanism adopting a spring as a biasing unit.
Figure 7B:
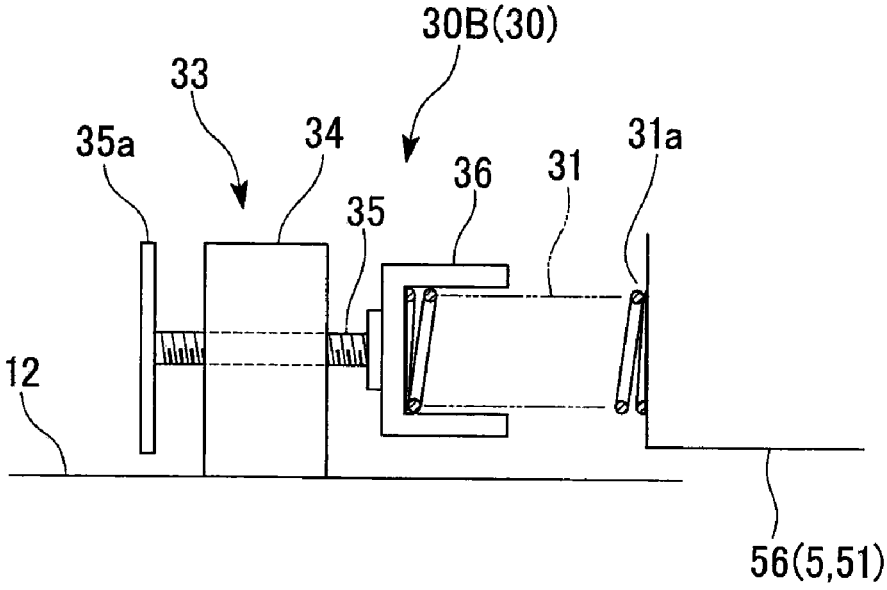

FIG. 1 is a front elevation showing the configuration of an electronic photograph printer according to the present invention. FIG. 2 is a plan view showing correlation among a photosensitive drum 2, a developer apparatus 5, and an air cylinder apparatus 21 of a pressing mechanism 20 in an electronic photograph printer 1. FIG. 3 shows correlation between a pair of developer apparatus frames 51, a developer roll 52, a toner supplier roll 53, cleaner roll 54, and guide rails 13 of the developer apparatus 5 taken along the line A-A of FIG. 1. FIG. 4 shows correlation between mover rolling balls 56 and the guide rails 13, provided in the developer apparatus frame. FIG. 5 shows an example of the pressing mechanism 20. FIG. 6 is a front elevation showing another aspect of the pressing mechanism 20A. FIGS. 7A and 7B are views for explaining pressing mechanism 30 (30A and 30B) using springs as biasing units.

The following explanation is based on the precondition that, in FIGS. 1, and 3 to 7B, components shown in an upper section of the drawing is disposed at a somewhat distant location from a floor line, and components shown in a lower section of the drawing are disposed on the floor or close to the floor line.

FIG. 1 shows the configuration of electronic photograph printer 1 including: the photosensitive drum 2; a static-charging apparatus 3; an exposure apparatus 4; the developer apparatus 5; a static-eliminating apparatus 6; a photosensitive-material cleaner 7; a transfer roll 8; a backup roll 9; a carrier-liquid-supplier apparatus 10; a transfer-roll-cleaner 11; a developer-apparatus-installation base 12; the guide rails 13; and a pressing mechanism 20.

Reference numeral 101 in FIG. 1 indicates a recording paper. A swathe of the elongated recording paper 101 is placed between the transfer roll 8 and the backup roll 9. The rotatable transfer roll 8 and the backup roll 9 may have a function of feed roll for feeding the recording paper 101.

A drive apparatus, not shown in the drawing, drives the photosensitive drum 2 rotatably supported by the frames, not shown in the drawing, of the electronic photograph printer 1. The photosensitive drum 2 rotates relative to the recording paper 101.

The static-charging apparatus 3 causes the surface of the photosensitive drum 2 to be charged statically and uniformly.

The exposure apparatus 4 removes the charges, statically applied on the surface of the photosensitive drum 2 by the static-charging apparatus 3, by means of exposure and forms a static latent image. The exposure apparatus 4 removes charges from at least a part of the surface of the photosensitive drum 2 by means of exposure.

The developer apparatus 5 provided with the rotative developer roll 52 making contact with the photosensitive drum 2 supplies toner (hereinafter the toner includes liquid toner) from the developer roll 52 to the photosensitive drum 2 and forms a toner image on the surface of the photosensitive drum 2 by visualizing the static latent image.

It should be noted that the details of the developer apparatus 5 and the correlation among the developer apparatus 5, the guide rails 13, and the pressing mechanism 20 will be explained later.

The static-eliminating apparatus 6 eliminates charges fully from the surface of the photosensitive drum 2.

The photosensitive-material cleaner 7 cleans the surface of the photosensitive drum 2 by removing objects (toner or the like) sticking to the surface of the photosensitive drum 2.

The rotative transfer roll 8 transfers the toner image formed on the surface of the photosensitive drum 2 onto the recording paper 101 while making contact with the photosensitive drum 2.

The backup roll 9 ensures that the transfer roll 8 applies a pressing force to the recording paper 101 while placing the recording paper 101 between the backup roll 9 and the transfer roll 8.

The carrier-liquid-supplier apparatus 10 supplies carrier liquid, in which toner grains are dispersed, onto the surface of the transfer roll 8.

The transfer-roll-cleaner 11 cleans the surface of the transfer roll 8 by removing objects (toner or the like) sticking to the surface of the transfer roll 8.

The static-charging apparatus 3, the exposure apparatus 4, the developer roll 52 of the developer apparatus 5, the static-eliminating apparatus 6, and the photosensitive-material cleaner 7 are disposed around the photosensitive drum 2 along the outer periphery of the photosensitive drum 2. These components are arranged in an order of the static-eliminating apparatus 6, the photosensitive-material cleaner 7, the static-charging apparatus 3, the exposure apparatus 4, and the developer roll 52 from a contact point P1, where the photosensitive drum 2 makes contact with the transfer roll 8, toward the downstream side with respect to the rotational direction of the photosensitive drum 2 (as indicated by an arrow a in FIG. 1).

The developer roll 52 is disposed upstream relative to the contact point P1, where the photosensitive drum 2 makes contact with the transfer roll 8, with respect to the rotational direction of the photosensitive drum 2 (as indicated by the arrow a in FIG. 1).

The backup roll 9, the carrier-liquid-supplier apparatus 10, and the transfer-roll-cleaner 11 are disposed around the transfer roll 8 along the outer periphery of the transfer roll 8. These components are arranged in an order of the backup roll 9, the carrier-liquid-supplier apparatus 10, and the transfer-roll-cleaner 11 from the contact point P1, where the photosensitive drum 2 makes contact with the transfer roll 8, toward the downstream side with respect to the rotational direction of the transfer roll 8 (as indicated by an arrow b in FIG. 1).

The transfer-roll-cleaner 11 is disposed upstream relative to the contact point P1, where the photosensitive drum 2 makes contact with the transfer roll 8, with respect to the rotational direction of the transfer roll 8 (as indicated by the arrow b in FIG. 1).

The developer apparatus 5 will be explained next.

FIGS. 1 to 3 show the configuration of the developer apparatus 5 including: a pair of developer apparatus frames 51 separately disposed from each other (reference numeral 51*a* and 51*b* are assigned for preventing confusion between two developer apparatus frames 51); the developer roll 52; the toner supplier roll 53; a cleaner roll 54; a toner reservoir 55; and movers 56 provided beneath developer apparatus frames 51*a* and 51*b*.

Reference numeral 57 shown in FIG. 3 indicates a coupler member which couples the developer apparatus frame 51*a* with the developer apparatus frame 51*b*.

The developer apparatus 5 is configured so that the components included therein (e.g., the developer roll 52, the toner supplier roll 53, the cleaner roll 54, and the toner reservoir 55) are supported by a main frame 58 having the pair of developer apparatus frames 51*a* and 51*b* coupled by the coupler member 57.

The rotative toner supplier roll 53 making contact with the developer roll 52 supplies toner (liquid toner) onto the surface of the developer roll 52. The lower part of the toner supplier roll 53 is immersed in a liquid toner 551 trapped in the toner reservoir 55 provided in the developer apparatus 5. The rotative toner supplier roll 53 making contact with the developer roll 52 applies the toner (liquid toner) onto the full surface of the developer roll 52.

The rotative cleaner roll 54 making contact with the developer roll 52 removes the toner from the surface of the developer roll 52.

The toner supplier roll 53 and the cleaner roll 54 are disposed around the developer roll 52 along the outer periphery of the developer roll 52 so that they are shifted from each other. These components are disposed in the order of the cleaner roll 54 and the toner supplier roll 53 from a contact point P2, where the photosensitive drum 2 makes contact with the developer roll 52, toward the downstream side with respect to the rotational direction of the developer roll 52 indicated by an arrow c shown in FIG. 1. The toner supplier roll 53 is positioned upstream relative to the contact point P2, where the photosensitive drum 2 makes contact with the developer roll 52, in the rotational direction of the developer roll 52 as indicated by an arrow c in FIG. 1.

As shown in FIG. 3, the developer roll 52, the toner supplier roll 53, and the cleaner roll 54 are disposed to be spanned across the pair of developer apparatus frames 51*a* and 51*b*.

The developer apparatus frames 51*a* and 51*b* each have bearings 512, 513, and 514 each rotatably supporting roll shafts 52*a*, 53*a*, and 54*a* of the rolls 52, 53, 54 that respectively correspond to the developer roll 52, the toner supplier roll 53, and the cleaner roll 54 in this order.

The bearings 512, provided to the pair of developer apparatus frames 51*a* and 51*b*, rotatably support the two ends of the roll shafts 52*a* of the developer roll 52. The bearings 513, provided to the pair of developer apparatus frames 51*a* and 51*b*, rotatably support the two ends of the roll shafts 53*a* of the toner supplier roll 53. The bearings 514, provided to the pair of developer apparatus frames 51*a* and 51*b*, rotatably support the two ends of the roll shafts 54*a* of the cleaner roll 54.

The developer apparatus 5 is disposed on the developer-apparatus-installation base 12 (hereinafter called an installation base for simplifying the expression thereof) installed in the main frame of the electronic photograph printer 1.

Provided on the installation base 12 are the pair of linear motion guide rails 13 that permit freely extendable or retractable movement of the developer apparatus 5 relative to the photosensitive drum 2. The movers 56 making contact with the guide rails 13 and provided beneath the developer apparatus frames 51*a* and 51*b* allow the developer apparatus 5 to make a linear motion along the longitudinal direction of the guide rails 13 while the movers 56 of the developer apparatus frames 51*a* and 51*b* make contact with the pair of guide rails 13.

FIG. 4 shows an example of the movers 56.

FIG. 4 shows the configuration of the mover 56 having a mover main unit 561 having an angular U-shape cross section into which the freely rotatable rolling balls 562 are assembled to make contact with the guide rails 13.

The mover main unit 561 includes a ceiling section 561*a* fixed to the developer apparatus frame 51; and a pair of lateral plate sections 561*b* and 561*c* projecting downward from two separate points on the ceiling section 561*a*. The mover main unit 561 has an inner space 561*d* which is surrounded by the ceiling section 561*a* and the pair of lateral plate sections 561*b* and 561*c* and is operable as a space for accommodating the guide rail 13.

The freely rotatable rolling balls 562 are assembled into the ceiling section 561*a* and the pair of lateral plate sections 561*b* and 561*c* of the mover main unit 561. In addition, each rolling ball 562 is provided to project into the inner space 561*d* from the ceiling section 561*a* or the pair of lateral plate sections 561*b* and 561*c* while making contact with the guide rails 13 accommodated in the inner space 561*d*.

The mover 56 moves along the longitudinal direction of the guide rails 13 while the three rolling balls 562 make contact with the guide rail 13 in three directions, i.e., in the vertical direction and in the horizontal direction defined on a cross section that is orthogonal to the longitudinal direction of the guide rails 13. This reduces the contact resistance between the developer apparatus 5 and the guide rails 13, therefore, permitting smooth linear movement of the developer apparatus 5 along the longitudinal direction of the guide rails 13.

It should be noted that the movers 56, not limited to the aforementioned configuration, may adopt various mechanisms. A mover including rolling balls making contact with the guide rails 13 may be preferable because the contact resistance between the developer apparatus 5 and the guide rails 13 can be reduced easily.

In addition, an adoptable configuration ensuring free linear guided movement of the developer apparatus 5 relative to the photosensitive drum 2 may be, for example, a mechanism that causes the developer apparatus 5 to float magnetically above the installation base 12 and to make linearly guided motion by means of engagement between the guide rails 13 and movers provided beneath the developer apparatus 5.

The pressing mechanism 20 will be explained next.

As shown in FIGS. 1 and 5, the pressing mechanism 20 presses the developer roll 52 of the developer apparatus 5 onto the photosensitive drum 2 while elastically biasing the developer apparatus 5.

In addition, the configuration explained in this case includes: the developer apparatus frames 51*a* and 51*b* each having the pressing mechanism 20; and the pressing mechanisms 20 each elastically biasing each one of the developer apparatus frames 51*a* and 51*b* that are linearly guided by the guide rails 13 so that the developer roll 52 is pressed onto the photosensitive drum 2.

The linear movement of the developer apparatus 5 along the guide rails 13 is orthogonal with respect to a rotational axis center 2*q* of the photosensitive drum 2 (see FIG. 2). The developer roll 52 is supported so that the direction of the rotational axis center 52*q* of the developer roll 52 coincides with that of the rotational axis center 2*q* of the photosensitive drum 2 in the developer apparatus 5.

In the following explanation associated with the moving direction of the developer apparatus 5 along the longitudinal direction of the guide rails 13, the photosensitive drum 2 is understood to be at a front side (i.e., the right-hand side relative to the developer apparatus 5 in FIG. 1) while the reverse end of the drawing indicates the rear side (i.e., left-hand side in FIG. 1).

The pressing mechanism 20 of the electronic photograph printer 1 illustrated in FIG. 1 will be explained.

As shown in FIGS. 1 and 5, the pressing mechanism 20 explained here is configured to include: the air cylinder apparatus 21; an air-pressure-supply line 23 for conveying air pressure (compressed air) supplied form an air pressure source 22 to the air cylinder apparatus 21; and a decompression valve 24 disposed somewhere in the air-pressure-supply line 23.

As illustrated in the drawings the air cylinder apparatus 21 of the of the pressing mechanism 20 has a cylinder main unit 21*c* fixed on the installation base 12 at the reverse side with respect to the photosensitive drum 2 so that the developer apparatus 5 is between the cylinder main unit 21*c* and the photosensitive drum 2 (i.e., the left-hand side in FIG. 1 relative to the developer apparatus 5). Subsequently, the developer apparatus frame 51 of the developer apparatus 5 is elastically biased from the reverse side relative to the photosensitive drum 2 toward the photosensitive drum 2 (front side in the movement direction) by a tip 21*b* (hereinafter called a movable end) of a movable shaft 21*a* projecting from the cylinder main unit 21*c* by means of air pressure supplied by the air pressure source 22.

As shown in FIGS. 1 to 3, provided in the lower part of the developer apparatus frame 51 is a receiver member 59 making contact with the tip 21*b* of the movable shaft 21*a* of the air cylinder apparatus 21.

The air cylinder apparatus 21 elastically biases the developer apparatus frame 51 so that the movable end 21*b* of the movable shaft 21*a* makes contact with the receiver member 59 of the developer apparatus frame 51 from the reverse side relative to the photosensitive drum 2 (i.e., from the rear side with respect to the moving direction of the developer apparatus 5).

As shown in FIG. 5, the movable shaft 21*a* of the air cylinder apparatus 21 is fixed to a piston 21*d* assembled in the cylinder main unit 21*c*. The movable end 21*b* of the movable shaft 21*a* elastically biasing the developer apparatus frame 51 corresponds to the tip of the projecting part of the movable shaft 21*a* projecting from the cylinder main unit 21*c*.

The air-pressure-supply line 23 connected to a connection port 21*f* disposed on the cylinder main unit 21*c* communicates with an inner chamber 21*e* disposed at the reverse side relative to the movable shaft 21*a* (i.e., in the vicinity of a cylinder head) via the piston 21*d* disposed in the cylinder main unit 21*c*. The air cylinder apparatus 21 elastically biases the developer apparatus frame 51 by means of air pressure supplied by the air-pressure-supply line 23 to the inner chamber 21*e*.

A space 21*g*, defined in the reverse side to the inner chamber 21*e* with respect to the piston 21*d* in the cylinder main unit 21*c*, is released to the atmosphere.

The decompression valve 24 executes a function of maintaining a fixed degree of secondary air pressure at between the decompression valve 24 and the air cylinder apparatus 21 in an air pressure circuit used for supplying air pressure from the air pressure source 22 to the air cylinder apparatus 21 via the air-pressure-supply line 23. The decompression valve 24 sets the degree of air decompression between a primary side and a secondary side in the air pressure circuit.

In addition, the decompression valve 24 allows air pressure to be supplied from the primary side to the secondary side upon acknowledging that the pressure in the secondary side including the decompression valve 24 and the air cylinder apparatus 21 is lower than the pressure in the primary side including the decompression valve 24 and the air pressure source 22.

The contact pressure between the developer roll 52 of the developer apparatus 5 and the photosensitive drum 2 in the electronic photograph printer 1 can be set easily by setting the secondary pressure by means of the decompression valve 24 of the pressing mechanism 20.

The contact pressure between the developer roll 52 and the photosensitive drum 2 can be adjusted easily by setting a degree decompression by using the decompression valve 24.

In addition, the two pressing mechanisms 20 are provided in the electronic photograph printer 1 corresponding to the two developer apparatus frames 51. Each developer apparatus frame 51 of the developer apparatus 5 is elastically biased toward the photosensitive drum 2 by the air cylinder apparatus 21 of each pressing mechanism 20.

Incidentally, the developer roll 52 and the photosensitive drum 2, while being rotated, may be sometimes subject to inevitable runout caused by machining tolerance or accuracy of bearings that are used for supporting their rotation around their rotational centers.

The electronic photograph printer 1 according to the present invention allows the developer roll 52 and the photosensitive drum 2 to make trackable movement with feasible runout since the pressing mechanism 20 elastically biases each developer apparatus frame 51 of the developer apparatus 5 by means of the pressing mechanism 20. Consequently, an immovable degree of the contact pressure can be maintained between the developer roll 52 and the photosensitive drum 2 at a position where the developer roll 52 makes contact with the photosensitive drum 2 along the full length of axial direction of the developer roll 52 and the photosensitive drum 2.

The runout of the rotating developer roll 52 can be compensated by moving the developer apparatus frames 51 separately; therefore, the contact state and contact pressure between the developer roll 52 and the photosensitive drum 2 can be maintained in a stable manner.

As shown in FIG. 4, a slight degree of clearance c1 should be ensured among the two lateral sides of each guide rail 13 and the rolling balls 562 of the movers 56 of the developer apparatus frame 51 for smoothing the advancing or retracting movement of each one of the pair of developer apparatus frame 51.

The clearance c1 allows each developer apparatus frame 51 to freely advance and retract (along the guide rails 13) by about ±1 millimeter.

The elasticity of the air in the secondary side of the air pressure circuit effectively compensates the fluctuation of the air pressure because the fluctuation of the air pressure in the secondary side caused by the advancing or retracting movement of the developer apparatus frame 51 is negligible between the decompression valve 24 and the air cylinder apparatus 21 in the air pressure circuit of the pressing mechanism 20.

When the developer roll 52 is pressed by the photosensitive drum 2 and the developer apparatus frame 51 is pressed to move slightly toward the rear side in the moving direction, the elasticity of the compressed air in the secondary side of the air pressure circuit (the secondary side of the air-pressure-supply line 23 and the inner chamber 21*e* of the air cylinder apparatus 21) in the pressing mechanism 20 for elastically biasing the developer apparatus frame 51 can prevent an increase in the contact pressure between the developer roll 52 and the photosensitive drum 2.

Preferably, the decompression valve 24 may be a breather decompression valve such as a relief valve. Alternatively, a relief valve may be connected to the secondary side of the air-pressure-supply line 23.

Accordingly, the upper limit value of the secondary side of the air pressure circuit can be set; therefore, an excessive degree of increase in the contact pressure between the developer roll 52 and the photosensitive drum 2 can be prevented by setting the upper limit value of the air pressure in the secondary side of the air pressure circuit.

Conversely, when the runout of the rotating photosensitive drum 2 causes the developer apparatus frame 51 to move slightly forward in the moving direction and the air pressure to be lowered in the secondary side, the decompression valve 24 can maintain the preset degree of air pressure in the secondary side because an appropriate degree of air pressure is supplied by the decompression valve 24 from the primary side to the secondary side.

The pressing mechanism 20 shown in FIG. 6 has an electro-pneumatic transducer 24A which is operable as the decompression valve 24.

The pressing mechanism 20A includes the electro-pneumatic transducer 24A, a pressure sensor 25, and a controller apparatus 26. The electro-pneumatic transducer 24A is disposed somewhere in the air-pressure-supply line 23 which is connected to the air pressure source 22. The pressure sensor 25 measures the contact pressure between the developer roll 52 and the photosensitive drum 2. The controller apparatus 26 sends an output-control signal (electric signal) for the air pressure to the electro-pneumatic transducer 24A based on a signal indicative of the pressure measured by the pressure sensor 25.

In the illustrated configuration, the pressure sensor 25 is disposed between the movable end 21*b* of the movable shaft 21*a* of the air cylinder apparatus 21 and the receiver member 59 of the developer apparatus frame 51 to measure the compressing force that acts on the pressure sensor 25 between the tip 21*b* of the movable shaft 21*a* of the air cylinder apparatus 21 and the receiver member 59 of the developer apparatus frame 51 because the compressing force indicates the contact pressure between the developer roll 52 and the photosensitive drum 2. A usable example of the pressure sensor 25 may be a piezoelectric sensor or the like.

The controller apparatus 26 of the pressing mechanism 20A enables accurate control of air pressure that is put out from the controller apparatus 26 based on the pressure value measured by the pressure sensor 25.

Consequently, more accurate contact pressure can be maintained in a stable manner between the developer roll 52 and the photosensitive drum 2.

From the viewpoint of maintaining highly accurate contact pressure between the developer roll 52 and the photosensitive drum 2, a preferable example of the air cylinder apparatus 21 may be a diaphragm cylinder, more specifically, a diaphragm cylinder manufactured by Marsh Bellofram (a group of U.S. liquid-flow-control-instrument manufacturers).

The movement of the developer apparatus 5 and the developer apparatus frame 51 along the guide rails 13 permits the free advance or retraction of the developer roll 52 relative to the photosensitive drum 2 by suspending the air pressure supplied from the air pressure source 22 to the air cylinder apparatus 21 to lower the air pressure in the secondary side of the air pressure circuit and by causing the movable shaft 21*a* of the air cylinder apparatus 21 to be prepared to reduce the projection degree of the movable shaft 21*a* relative to the cylinder main unit 21*c*, or by reducing the projection degree so that the biasing force is released. This readily improves workability during maintenance of the developer roll 52 and the photosensitive drum 2.

Connecting a shut-off valve 27 to the secondary side of the air-pressure-supply line 23, more specifically, to a secondary piping 23*b* as shown in FIGS. 5 and 6, and releasing the shut-off valve 27 will expedite the dropdown of air pressure in the secondary side of the air pressure circuit. The shut-off valve 27 may be provided in the air cylinder apparatus 21. In this configuration, an alternately usable example of the decompression valve 24 may be a breather decompression valve having an exhaust port so that the decompression valve 24 may also serve as a shut-off valve for reducing the air pressure in the secondary side of the air pressure circuit.

Shutting off a temporarily opening state of the shut-off valve 27 causes air to be supplied from the primary side to the secondary side in the air pressure circuit of the pressing mechanism 20, thereby allowing the decompression valve 24 to obtain the preset value of air pressure in the secondary side and thereby allowing the pressing mechanism 20 to elastically bias the developer apparatus frame 51.

The shut-off valve 27 is operable as a press-switching unit for applying a biasing force applied by the pressing mechanism 20 to the developer apparatus 5 and for switching the force between continued state and suspended state.

(Another Aspect of the Pressing Mechanism)

FIGS. 7A and 7B show another aspect of the pressing mechanism 30.

As shown in FIGS. 7A and 7B, the pressing mechanism 30 adopts a spring 31 that is a biasing means which elastically biases the developer apparatus frame 51 of the developer apparatus 5.

Similarly to the aforementioned pressing mechanism 20, the pressing mechanism 30, provided to each developer apparatus frame 51 of the developer apparatus 5, elastically biases each developer apparatus frame 51, more specifically, the receiver member 59 to press the developer roll 52 onto the photosensitive drum 2.

The spring 31 adopted in the illustrated pressing mechanism 30 is a coil spring.

Reference symbol 30A assigned in FIG. 7A also indicates the pressing mechanism so as to be distinguishable from the previously explained pressing mechanism 30. The pressing mechanism 30A has a spring receiver member 32 fixed on the installation base 12 so that one of two ends of the spring 31 in the axial direction is fixed to the spring receiver member 32. In this configuration, the other end of the spring 31 in the axial direction, more specifically, an actuating end 31*a* is caused to make contact with the developer apparatus frame 51, more specifically, with the receiver member 59 so that the developer apparatus frame 51 is elastically biased to the photosensitive drum 2, i.e., to the front side in the moving direction by means of the elasticity of the spring 31.

Reference symbol 30B assigned in FIG. 7B also indicates the pressing mechanism so as to be distinguishable from the previously explained pressing mechanism 30. The pressing mechanism 30B has the coil spring 31 and a spring-pressing mechanism 33 that presses the spring 31 to the developer apparatus frame 51.

The illustrated spring-pressing mechanism 33 is configured to include a fixture block 34 fixed on the installation base 12; and a pressing screw 35 having a handle 35*a* and backing up the spring 31. Rotating a proximal end of the handle 35*a* of the pressing screw 35, which penetrates the fixture block 34, allows a spring receiver member 36, provided on the reverse end, to be positioned along the moving direction of the developer apparatus frame 51 guided by the guide rails 13. The spring 31 elastically biases the developer apparatus frame 51 so that the two ends of the spring 31 in its axial line direction are placed between the spring receiver member 36 and the receiver member 59 of the developer apparatus frame 51. In addition, the pressing mechanism 30B rotates the pressing screw 35 to reduce the projection degree of the tip of the pressing screw 35 relative to the fixture block 34 and elastically biasing the developer apparatus frame 51 by the spring 31. Consequently, the position of the spring receiver member 36 can be adjusted so that the developer roll 52 can advance or retract relative to the photosensitive drum 2.

The spring-pressing mechanism 33 is operable as a press-switching unit for applying a biasing force from the pressing mechanism 30 to the developer apparatus 5 and for switching the force between the continued state and the suspended state.

The spring pressing mechanism may be not limited to the aforementioned configuration and may adopt various configurations as long as it achieves elastic biasing of the developer apparatus frame 51 by means of elasticity of a spring.

A more preferably adoptable component may have a function of the aforementioned press-switching unit that switches the force applied to the developer apparatus 5 from the pressing mechanism between the continued state and the suspended state.

As previously explained, the electronic photograph printer 1 according to the present invention, which is configured to elastically bias each developer apparatus frame 51 of the developer apparatus 5 by the pressing mechanism 20 or by the pressing mechanism 30, allows the developer roll 52 to reliably make trackable movement with feasible runout of at least one of the photosensitive drum 2 and the developer roll 52. Consequently, an immovable degree of uniform contact pressure can be maintained uniformly between the developer roll 52 and the photosensitive drum 2 at a position where the developer roll 52 makes contact with the photosensitive drum 2 along the full length of axial direction of the developer roll 52 and the photosensitive drum 2. This results in obtaining uniform quality of developed toner image.

In addition, the electronic photograph printer 1 is configured to elastically bias the developer apparatus frame 51 of the developer apparatus 5 including the developer roll 52 by means of the pressing mechanism so that the developer roll 52 is pressed onto the photosensitive drum 2; therefore, the trackable movement of the developer roll 52 with the movement of the photosensitive drum 2 does not affect adjustment carried out in the developer apparatus 5, such as positioning of the developer roll 52 relative to components making contact with the developer roll 52, e.g., the toner supplier roll 53 and the cleaner roll 54. Consequently, the developer apparatus 5 can maintain a stable post-adjustment condition.

The contact pressure between the developer roll 52 and the photosensitive drum 2 achieved by means of the biasing force applied to the developer apparatus frame 51 of the developer apparatus 5 by the pressing mechanism readily reduces the workload for adjusting the position of the developer roll 52 in the developer apparatus 5. Accordingly, adjustment carried out in the developer apparatus 5, such as positioning of the developer roll 52 relative to components making contact with the developer roll 52, e.g., the toner supplier roll 53 and the cleaner roll 54 is facilitated than in a conventional case. That is, operability and maintainability improvements associated with the inner mechanism of the developer apparatus 5 can reduce the total workload for adjusting the inner mechanism of the developer apparatus 5. Additionally, profitability also improves due to the reduced maintenance cost.

(Another Embodiment)

Another embodiment of the present invention will be explained with reference to FIGS. 8 to 10.

Figure 8:
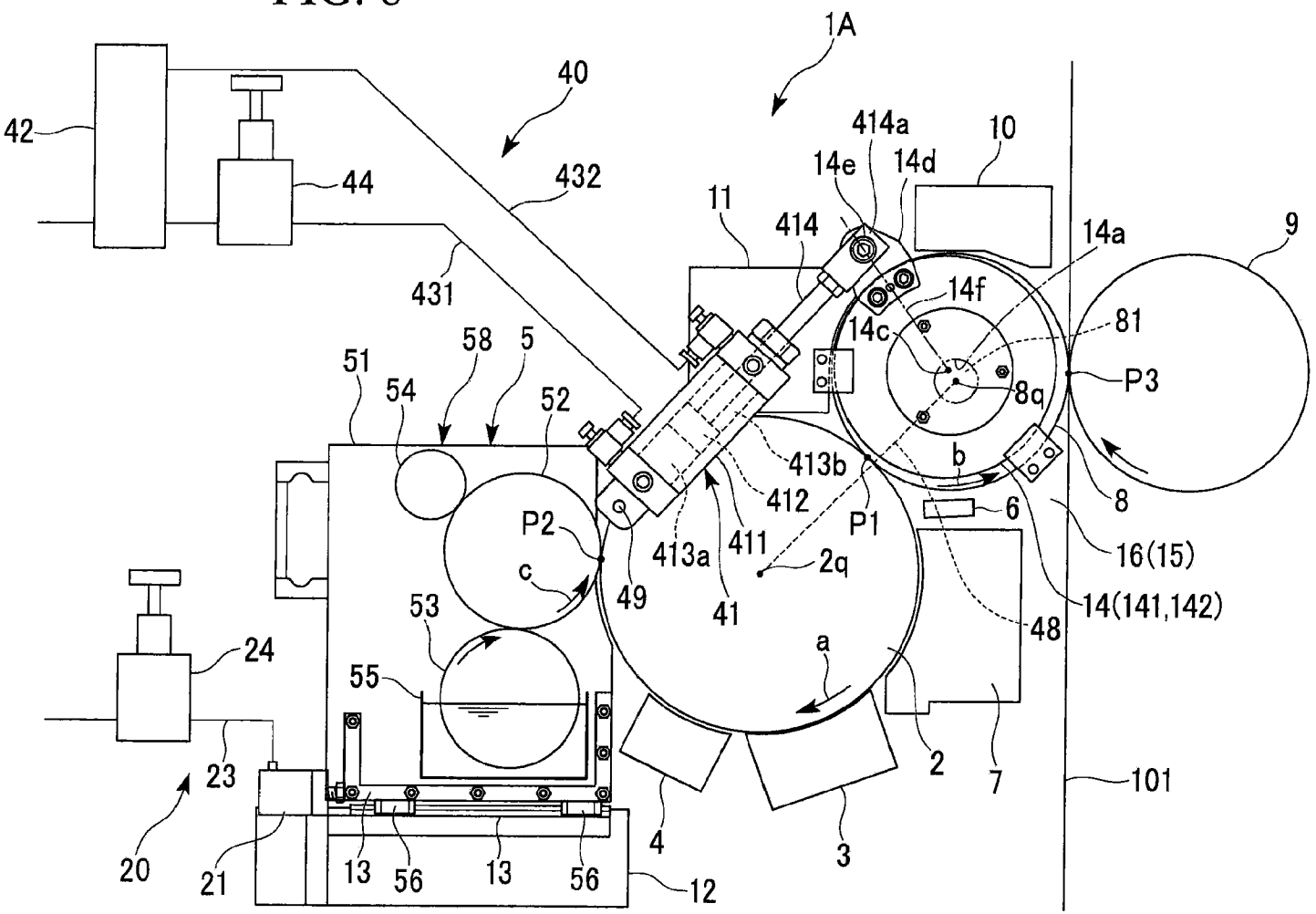
FIG. 8 is a front elevation showing another embodiment of the electronic photograph printer according to the present invention.

The following explanation is based on the precondition that, in FIG. 8, components shown in an upper section of the drawing are disposed at a somewhat distant location from a floor line, and components shown in a lower section of the drawing are disposed on the floor or close to the floor line.

An electronic photograph printer according to the present embodiment explained here has a transfer-roll-pressing mechanism 40 or the like provided to the previously explained electronic photograph printer 1.

FIG. 8 shows a configuration of the pressing mechanism for elastically biasing the developer apparatus 5 adopting the air cylinder apparatus 21 illustrated in FIG. 1 as a biasing means. The pressing mechanism adopted to the electronic photograph printer 1 explained here may adopt various types of pressing mechanism as long as it is adoptable to the previously explained electronic photograph printer according to the present invention including the pressing mechanism 20A shown in FIG. 6 and the pressing mechanism 30 shown in FIGS. 7A and 7B.

A support mechanism for rotatably supporting the transfer roll 8 will be explained first.

Reference numeral 14 shown in FIGS. 8 and 9 indicates a transfer-roll-support member which movably supports the transfer roll 8 relative to the main frame of the printer (hereinafter simply called the main frame).

The transfer-roll-support member 14 rotatably supports the two ends of a roll shaft 81 of the transfer roll 8 via bearings.

The transfer-roll-pressing mechanism 40 elastically biases the transfer-roll-support member 14. The transfer roll 8 is elastically biased to the photosensitive drum 2 by the force applied by the transfer-roll-pressing mechanism 40 and acting on the transfer-roll-support member 14.

The transfer-roll-support member 14 may be configured to advance or retract relative to the photosensitive drum 2 unitarily with the transfer roll 8 from the viewpoint of achieving the elastic biasing of the transfer-roll-pressing mechanism 40 conducted to the transfer roll 8 relative to the photosensitive drum 2. The present embodiment provides an example of configuration adopting a ring-shaped transfer-roll-support member 14 (hereinafter called a ring support) that is supported rotatably around the axial line of the main frame via a bearing 17 (hereinafter called support bearing 17).

Figure 9:
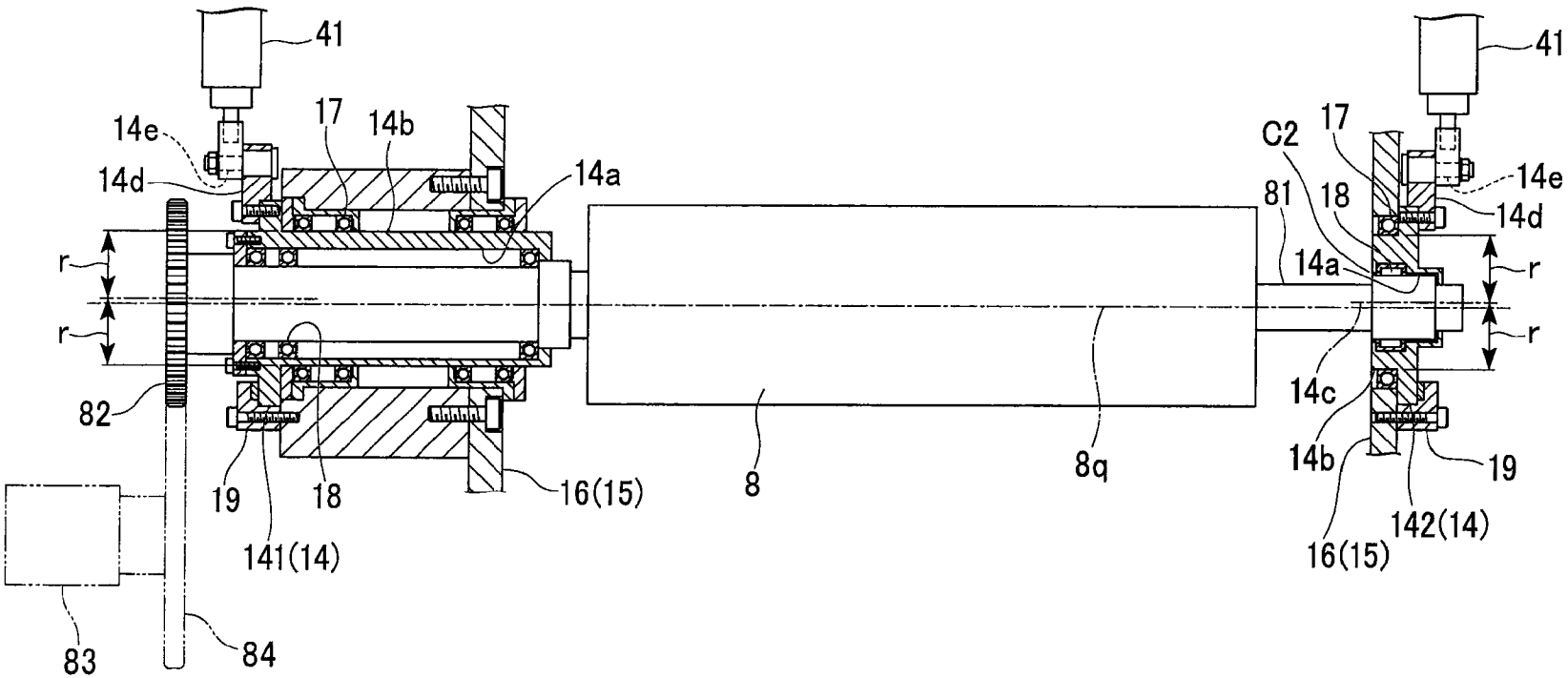
FIG. 9 shows correlation among the transfer roll, the transfer-roll-support member (ring support), and an air cylinder apparatus in the electronic photograph printer shown in FIG. 8.

The transfer-roll-support member 14, which is rotatable around the axial line as shown in FIGS. 8 and 9, is supported by the support bearing 17 on longitudinal walls 16 provided in the main frame of the printer (machine frame 15). Reference numeral 19 in the drawings indicates a holder for preventing the transfer-roll-support member 14 from falling off from the longitudinal walls 16. The transfer-roll-support member 14 upon rotating around the axial line slides on the holder member 19.

Two ends of the roll shaft 81 of the transfer roll 8 rotatable around the axial line relative to the transfer-roll-support member 14 is supported by two sets of bearings 18 (hereinafter roll bearings) disposed inward relative to the transfer-roll-support member 14. The transfer roll 8 is supported so that its rotational axis is parallel with the rotational axis center 2*q* of the photosensitive drum 2.

It should be noted that rolling-element bearings used here in the support bearing 17 and the roll bearing 18 may be replaced by non-rolling-element bearings such as sliding bearings.

In addition, FIG. 9 shows that the pair of transfer-roll-support members 14 are provided corresponding to the two ends of the roll shaft 81 of the transfer roll 8. One of the transfer-roll-support members (a transfer-roll-support member 142 as shown in the right-hand side of FIG. 9) has a sleeve shape, and the other one of the transfer-roll-support members (a transfer-roll-support member 143 as shown in the left-hand side of FIG. 9) has the hole 14*a* that is formed through the center of a round disk.

In addition, reference numeral 82 shown in FIG. 9 indicates a drive-force-transmission gear fixed to the roll shaft 81 of the transfer roll 8; and reference numeral 83 indicates a drive motor for driving the rotation of the transfer roll 8. The transfer roll 8 is rotated by the rotational driving force of the drive motor 83 transferred via a driving-force transmission system having a gear 84 and the like to the drive-force-transmission gear 82.

The following explanation is based on precondition that the center with respect to the curved line of an outer periphery surface 14*b* of the transfer-roll-support member 14 making contact with the support bearing 17 coincides with a center 14*c* of the transfer-roll-support member 14. The outer periphery surface 14*b* is a part of the perfect circle defined based on the center 14*c*.

Reference symbol r in FIG. 9 indicates the radius of the outer periphery surface 14*b*.

The position of the center of the hole 14*a* of the transfer-roll-support member 14 is shifted from the center 14*c* of the transfer-roll-support member 14 while the center of the hole 14*a* coincides with a rotational axis center 8*q* of the transfer roll 8. The roll shaft 81 of the transfer roll 8 is inserted in the roll bearing 18 in the hole 14*a* of the transfer-roll-support member 14. The transfer roll 8 in this state is rotatably supported while being eccentric relative to the outer periphery surface 14*b* of the transfer-roll-support member 14. Therefore, when the transfer-roll-support member 14 is rotated around the center 14*c* relative to the main frame of the printer (machine frame 15), the transfer roll 8 is moved, and the distance between the transfer roll 8 and the photosensitive drum 2 becomes variable. This results in allowing the transfer roll 8 to advance or retract relative to the photosensitive drum 2.

FIG. 8 shows an air cylinder apparatus 41 disposed in the transfer-roll-pressing mechanism 40 for elastically biasing the transfer roll 8 onto the photosensitive drum 2.

Fixed on the outer periphery of the transfer-roll-support member 14 is a coupler member 14*d* that is attached to the tip of a movable shaft 414 of the air cylinder apparatus 41. A coupling pin 14*e* pivotally couples the coupler member 14*d* to a tip section 414*a* of the movable shaft 414 of the air cylinder apparatus 41.

The end part (shown in a lower part in the left-hand side in FIG. 8 in the vicinity of a cylinder head) of the cylinder main unit 411 that accommodates a piston 412 therein is pivotably connected to the main frame of the printer (machine frame 15). The tip side of the movable shaft 414 can pivot in accordance with the rotation of the air cylinder apparatus 41 around the connection pin 49.

Furthermore, the air cylinder apparatus 41 is disposed so that the longitudinal direction of the movable shaft 414 does not coincide with a virtual line 14*f* defined by connecting the center 14*c* of the transfer-roll-support member 14 and the coupling pin 14*e*.

As shown in FIG. 8, the coupling pin 14*e* is positioned above the transfer-roll-support member 14 via the connection pin 49. The tip section 414*a* of the movable shaft 414 of the air cylinder apparatus 41 is connected to the coupling pin 14*e*. The air cylinder apparatus 41 diagonally extends from the coupling pin 14*e*.

The transfer-roll-pressing mechanism 40 is configured to selectively supply the air pressure produced by an air pressure source (not shown in the drawing) to two inner chambers 413*a* and 413*b* via a three-way switching valve 42 (solenoid valve) and the piston 412 disposed in the cylinder main unit 411 of the air cylinder apparatus 41. Hereinafter, the inner chambers 413*a* and 413*b* will be explained based on a precondition that one of the inner chambers may be called the first inner chamber 413*a* (main chamber) and the other one may be called the second inner chamber 413*b*.

The pair of inner chambers 413*a* and 413*b* of the air cylinder apparatus 41 are connected to two output ports of the three-way switching valve 42 via air-pressure-supply-lines 431 and 432 respectively.

A decompression valve 44 is interposed in the air-pressure-supply-line 431 (hereinafter called as a first air-pressure-supply-line) that communicates between the first inner chamber 413*a* and the three-way switching valve 42.

The decompression valve 44 supplies air pressure from the primary side of the first air-pressure-supply-line 431 (between the decompression valve 44 and the three-way switching valve 42) to the secondary side (between the decompression valve 44 and the first inner chamber 413*a*) at a preset pressure so that the air pressure supplied by the air pressure source is lowered by the decompression valve 44. The air pressure is allowed to be supplied from the primary side to the secondary side when the pressure in the secondary side is lower than the preset pressure. Accordingly, the preset pressure is maintained in the secondary side.

During the operation of the printer, an input port of the three-way switching valve 42 of the transfer-roll-pressing mechanism 40 is connected to the first air-pressure-supply-line 431 to supply air pressure to the first inner chamber 413*a* so that the first inner chamber 413*a* has an air pressure preset by the decompression valve 44. This provides an actuating force (biasing force) to the movable shaft 414 of the air cylinder apparatus 41 in the direction so that the projection degree of the movable shaft 414 increases relative to the cylinder main unit 411. The actuating force may be a rotational driving force acting on the transfer-roll-support member 14 via the coupling pin 14*e*.

The second air-pressure-supply line 432 in this state is released to atmosphere by the three-way switching valve 42.

In the following explanation, an operating state indicates a temporary state of the transfer-roll-pressing mechanism 40 in which the first air-pressure-supply-line 431 is connected to the input port of the three-way switching valve 42 to supply air pressure; and the second air-pressure-supply line 432 is released to atmosphere by the three-way switching valve 42.

As shown in FIG. 8, the rotational axis center 8*q* of the transfer roll 8 pivotably supported by the transfer-roll-support members 14 is shifted from the center 14*c* of the transfer-roll-support member 14 in the direction opposite the coupling pin 14*e*. The position (contact point P1) where the photosensitive drum 2 makes contact with the transfer roll 8 is set to come to have a distance between the contact point P1 and the center 14*c* of the transfer-roll-support member 14 so that the distance is the average of the minimum and the maximum of the distance between the center 14*c* and the circumference of the transfer roll 8.

Accordingly, connecting the input port of the three-way switching valve 42 to the first air-pressure-supply-line 431 and supplying air pressure to the first inner chamber 413*a* of the air cylinder apparatus 41 provide a rotational driving force to the transfer-roll-support member 14 so that the point of the outer periphery of the transfer roll 8 that has the maximum distance from the center 14*c* of the transfer-roll-support member 14 approaches the contact point P1 where the photosensitive drum 2 makes contact with the transfer roll 8. As shown in FIG. 8, the rotational driving force is applied to the transfer roll 8 in a clockwise direction around the center 14*c* of the transfer-roll-support member 14. Therefore, the contact pressure at the contact point P1 where the photosensitive drum 2 makes contact with the transfer roll 8 can be adjusted by adjusting the air pressure in the first inner chamber 413*a* of the air cylinder apparatus 41. The decompression valve 44 can set the air pressure in the first inner chamber 413*a*.

The transfer roll 8 in the operating state is elastically biased onto the photosensitive drum 2 by the biasing force of the air cylinder apparatus 41 for biasing the transfer-roll-support member 14, i.e., by the rotational driving force applied to the transfer-roll-support member 14. Therefore, the transfer roll 8 can be pressed onto the photosensitive drum 2 reliably.

In addition, in the electronic photograph printer 1A, the two transfer-roll-pressing mechanisms 40 provided corresponding to the pair of transfer-roll-support members 14 elastically and separately bias the pair of transfer-roll-support members 14 that rotatably support the two ends of the roll shaft 81 of the transfer roll 8. This enables reliable trackable movement of the transfer roll 8 with the movement of the photosensitive drum 2 even if at least one of the photosensitive drum 2 and the transfer roll 8 has the runout of rotation. The transfer roll 8 can maintain the contacting state with the photosensitive drum 2 because the transfer-roll-support members 14, supporting the transfer roll 8 at the two ends thereof, are rotated respectively around the axial line so as to compensate the runout of the rotation of the transfer roll 8.

This results in achieving uniform and stable contact pressure between the photosensitive drum 2 and the transfer roll 8 over the total length in the direction along the photosensitive drum 2 and the rotational axis centers 2*q* and 8*q* of the transfer roll 8 at the contact point P1 where the photosensitive drum 2 makes contact with the transfer roll 8.

Figure 10:
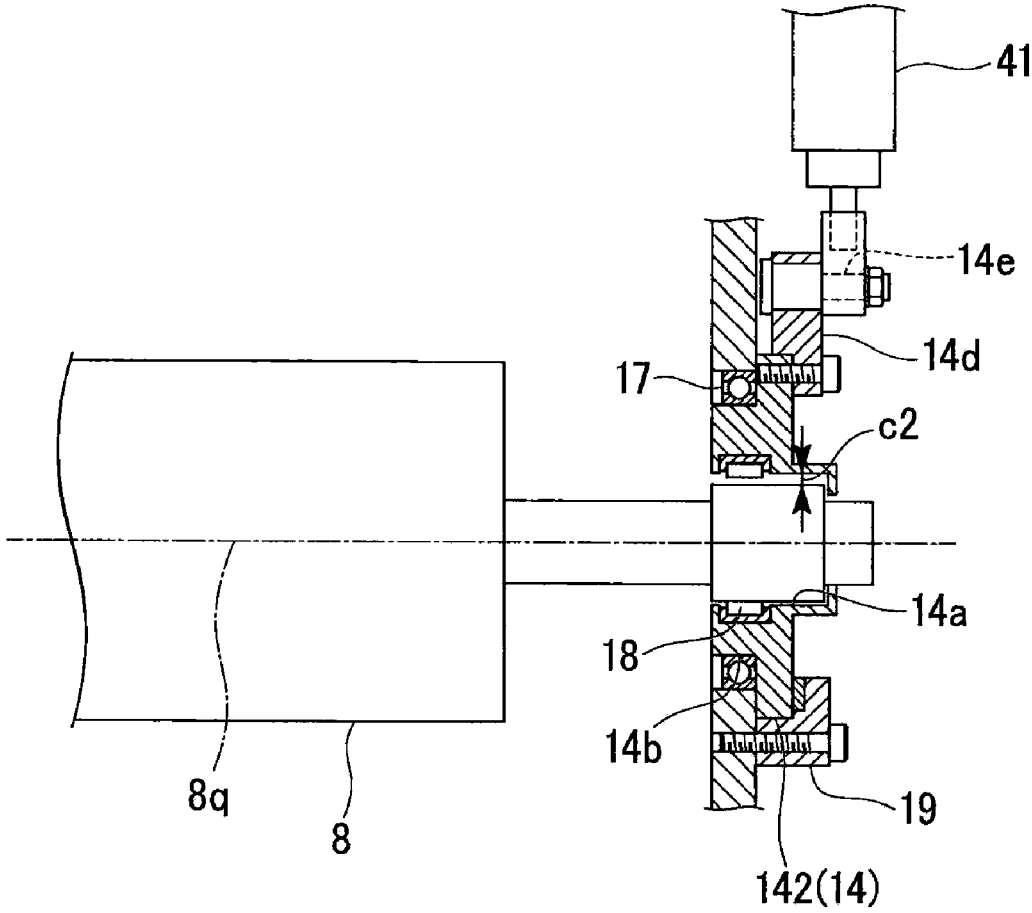
FIG. 10 shows clearance obtained between bearings receiving rolls and disposed inwardly relative to the transfer-roll-support member (ring support) shown in FIG. 9.

More preferably, a slight degree of clearance c2 should be ensured between the roll bearing 18 and the outer periphery of the roll shaft 81 of the transfer roll 8 provided within the roll bearing 18 as shown in FIG. 10 for smoothing the rotational displacement of each transfer-roll-support member 14 that is caused by the rotation of the transfer-roll-support member 14 around the center 14*c*.

In this configuration, the clearance c2 may allow about ±1 millimeter of free movement of the two ends of the roll shaft 81 of the transfer roll 8 with respect to advancing or retracting direction of the roll shaft 81 relative to the photosensitive drum 2, i.e., the direction along a virtual line 48 that connects the photosensitive drum 2 and the rotational axis centers 2*q* and 8*q* of the transfer roll 8 as shown in FIG. 8 to enable free rotation of each transfer-roll-support member 14.

The fluctuation of the air pressure caused by the runout of the rotation of the photosensitive drum 2 and the transfer roll 8 is negligible in the first inner chamber 413*a* of the air cylinder apparatus 41 in the secondary side of the first air-pressure-supply-line 431; therefore, the elasticity of air conformed in the air pressure circuit of the transfer-roll-pressing mechanism 40 effectively assists the compensation for the fluctuation of air pressure.

More preferably, the decompression valve 44 may be a breather decompression valve such as a relief valve. Alternatively, a relief valve may be connected to the secondary side of the first air-pressure-supply-line 431. This provides a capability of responding to a case in which the elasticity of air cannot balance the increase in the air pressure in the secondary side of the first air-pressure-supply-line 431, thereby stabilizing air pressure in the first inner chamber 413*a* of the air cylinder apparatus 41 in the secondary side of the first air-pressure-supply-line 431.

Conversely, if the air pressure in the secondary side of the first air-pressure-supply-line 431 is lowered, the air pressure in the secondary side can be maintained by the air pressure produced by the decompression valve 44 between the primary side and the secondary side.

From the viewpoint of maintaining highly accurate contact pressure between the transfer roll 8 and the photosensitive drum 2, a preferable example of the air cylinder apparatus 41 may be a diaphragm cylinder, more specifically, a diaphragm cylinder manufactured by Marsh Bellofram® (a group of U.S. liquid-flow-control-instrument manufacturers).

In addition, an actuating force that reduces the projection length of the movable shaft 414 of the air cylinder apparatus 41 relative to the cylinder main unit 411 can be applied to the movable shaft 414 by connecting the second air-pressure-supply line 432 to the input port of the three-way switching valve 42 and by releasing the first air-pressure-supply-line 431 to the atmosphere by the three-way switching valve 42. In the following explanation, a maintenance state indicates the transfer-roll-pressing mechanism 40 in this state.

Switching the transfer-roll-pressing mechanism 40 from the operating state to the maintenance state causes the movable shaft 414 to produce an actuating force in the reverse direction so that the switched direction of actuating force indicates reduced projection degree of the movable shaft 414 relative to the movable shaft 414, thereby providing a rotative driving force to the transfer-roll-support member 14 so that the contact point P1 where the photosensitive drum 2 makes contact with the transfer roll 8 is set so as to have a distance between the contact point P1 and the center 14*c* of the transfer-roll-support member 14 while the distance is the average of the minimum and the maximum of the distance between the center 14*c* and the circumference of the cross section of the transfer roll 8.

A clearance of one to several millimeters between the transfer roll 8 and the transfer-roll-support member 14 and depending on the degree of eccentricity of the transfer-roll-support member 14 with respect to the center 14*c* is set to be the average of the minimum and the maximum of the distance between the center 14*c* and the circumference of the transfer roll 8. This allows the transfer roll 8 to be separated from the photosensitive drum 2 while the transfer-roll-pressing mechanism 40 is in the maintenance state, thereby providing effective operation for maintenance.

The electronic photograph printer 1A can separate the transfer roll 8 from the photosensitive drum 2 by switching the transfer-roll-pressing mechanism 40 between the operating state and the maintenance state, more specifically, by actuating the three-way switching valve 42.

The three-way switching valve 42 has a function of the press-switching unit (a press-switching unit for use in the transfer roll) for switching the biasing force applied to the transfer-roll-support member 14 between the continued state and the suspended state.

In addition, the backup roll 9 should be positioned so that the distance between the backup roll 9 and the center 14*c* of the transfer-roll-support member 14 at a contact point P3 where the recording paper 101 is placed between the backup roll 9 and the transfer roll 8 is ensured to be significantly greater than the distance between the backup roll 9 and the center 14*c* of the transfer-roll-support member 14 at the contact point P1 where the transfer roll 8 makes contact with the photosensitive drum 2.

This can restrain the fluctuation in the distance between the center of the backup roll 9 and the center of the transfer roll 8 at a lower degree than the fluctuation in the distance between the center of the transfer roll 8 and the photosensitive drum 2 when transfer roll 8 rotates around the center 14*c* of the transfer-roll-support member 14.

Conventional electronic photograph printers use a common method in which the center of the photosensitive drum and the center of the transfer roll are adjusted to correct positions and fixed there, and then a toner image is transferred via transfer rolls and recorded onto a recording medium such as a recording paper.

However, the aforementioned electronic photograph printer 1A allows the transfer roll 8 to be separated from the photosensitive drum 2 while the transfer-roll-pressing mechanism 40 is in the maintenance state, thereby enabling effective maintenance work.

In addition to the reliably obtained stable contact state and the uniform and stable contact pressure between the photosensitive drum 2 and the developer roll 52, the electronic photograph printer 1A can achieve a table contact state and the uniform and stable contact pressure between the photosensitive drum 2 and the transfer roll 8. In terms of restraining the runout of the rotation of the photosensitive drum 2, the reliable and stable contact state and the uniform and stable contact pressure among the developer roll 52, the transfer roll 8 and the photosensitive drum 2 achieved while the developer roll 52 and the developer apparatus 5 make contact with the photosensitive drum 2 in two opposite directions are advantageous than in a case which attempts to obtain reliable and stable contact state and uniform and stable contact pressure between the photosensitive drum 2 and the developer roll 52 by means of the pressing mechanism 20 alone; therefore, the present invention effectively contributes to improvement in developing and printing quality.

Although the present invention has been described with respect to its preferred embodiments, the present invention is not limited to the embodiments described above. The configuration of the present invention allows for addition, omission, substitution and further modification without departing from the spirit and scope of the present invention.

For example, the aforementioned transfer-roll-pressing mechanism 40 may be adoptable as a pressing mechanism for elastically biasing the developer apparatus 5.

What is claimed is:

1. An electronic photograph printer comprising:

a photosensitive drum that is rotative relative to a recording paper;

a static-charging apparatus for statically charging a surface of the photosensitive drum uniformly;

an exposure apparatus for forming a static latent image on the surface of the photosensitive drum statically charged by the static-charging apparatus;

a rotative developer roll making contact with the photosensitive drum;

a developer apparatus for supplying a toner from the developer roll to the photosensitive drum and forming a toner image by visualizing the static latent image onto the surface of the photosensitive drum;

a roll-support member rotatably supporting the developer roll via a bearing; and a pressing mechanism for discharging an elastically biasing force to the roll-support member and pressing the developer roll of the developer apparatus onto the photosensitive drum;

wherein the pressing mechanism comprises:

an air cylinder apparatus configured to apply the elastically biasing force to the roll-support member;

an air-pressure-supply line configured to convey air pressure supplied from an air pressure source to the air cylinder apparatus; and a decompression valve disposed in the air-pressure-supply line; and wherein the decompression valve is configured to maintain a fixed degree of air pressure between the decompression valve and the air cylinder apparatus, in an air pressure circuit used for supplying air pressure from the air pressure source to the air cylinder apparatus via the air-pressure-supply line;

the roll-support member is formed as a circular member in which the bearing is placed at a position different from a center position of the circular member, and is configured so that a distance between the bearing and the photosensitive drum is changed by rotating the circular member; and the air cylinder apparatus is configured to apply the elastically biasing force to rotate the roll-support member.

2. The electronic photograph printer according to claim 1, wherein the developer apparatus includes:

the developer roll; and a pair of developer apparatus frames each having bearings, and for receiving a roll shaft of the developer roll and supporting two ends of the roll shaft, and each developer apparatus frame has the guide rail and the pressing mechanism.

3. The electronic photograph printer according to claim 1, wherein the pressing mechanism has a press-switching unit for switching the biasing force applied to the developer apparatus between continued state and suspended state, and the developer roll of the developer apparatus freely advances or retracts relative to the photosensitive drum by moving the developer apparatus along the guide rail while the elastic biasing force applied by the pressing mechanism to the developer apparatus is in the suspended state.

4. The electronic photograph printer according to claim 2, wherein the developer apparatus further includes a toner supplier roll and a cleaner roll, wherein the toner supplier roll supplies the toner onto a surface of the developer roll, the cleaner roll for removing the toner from the surface of the developer roll is disposed downstream in a rotating direction of the developer roll relative to a position where the developer roll makes contact with the photosensitive drum and is disposed upstream in the rotating direction of the developer roll relative to the toner supplier roll, and the toner supplier roll and the cleaner roll are rotatably supported by the developer apparatus frames.

5. The electronic photograph printer according to claim 1, further comprising:

a rotative transfer roll making contact with the photosensitive drum for transferring the toner image formed on the surface of the photosensitive drum onto the recording paper from the photosensitive drum;

a pair of transfer-roll-support members each having a bearing for supporting each one of two ends of the roll shaft of the transfer roll, the pair of transfer-roll-support members being movable relative to a main frame of the electronic photograph printer; and a transfer-roll-pressing mechanism for elastically biasing each transfer-roll-support member and pressing the transfer roll onto the photosensitive drum, the transfer-roll-pressing mechanism being provided to each transfer-roll-support member.

6. The electronic photograph printer according to claim 5, wherein the transfer-roll-pressing mechanism includes a transfer-roll-press-switching unit for switching the elastic biasing force applied to the transfer-roll-support member between the continued state and the suspended state, wherein the transfer roll is capable of freely separating from the photosensitive drum while the elastic biasing force applied by the transfer-roll-pressing mechanism to the transfer-roll-support member is in the suspended state.

7. The electronic photograph printer according to claim 2, wherein the pressing mechanism has a press-switching unit for switching the biasing force applied to the developer apparatus between continued state and suspended state, and the developer roll of the developer apparatus freely advances or retracts relative to the photosensitive drum by moving the developer apparatus along the guide rail while the elastic biasing force applied by the pressing mechanism to the developer apparatus is in the suspended state.

8. The electronic photograph printer according to claim 1, wherein the pressing mechanism further comprises:

A pressure sensor configured to measure the contact pressure between the developer roll and the photosensitive drum; and a controller apparatus which sends an output-control signal for the air pressure to the decompression valve based on a signal indicative of the pressure measured by the pressure sensor.

* * * * *